US006053151A

United States Patent [19]

Cook et al.

[11] Patent Number: 6,053,151

[45] Date of Patent: Apr. 25, 2000

[54] AUTOMOTIVE EVAPORATIVE EMISSION LEAK DETECTION SYSTEM AND MODULE

[75] Inventors: John E. Cook; Paul D. Perry; Paul V. Terek, all of Chatham, Canada

[73] Assignee: Siemens Canada Limited, Mississauga, Canada

[21] Appl. No.: 09/036,129

[22] Filed: Mar. 6, 1998

Related U.S. Application Data

[60] Provisional application No. 60/058,275, Sep. 9, 1997, and provisional application No. 60/058,151, Sep. 8, 1997.

[51] Int. Cl.[7] ..... F02M 37/04

[52] U.S. Cl. ..... 123/520; 137/907

[58] Field of Search ..... 123/516, 518, 123/519, 520; 137/526, 907

[56] References Cited

U.S. PATENT DOCUMENTS

| | | | |
|---|---|---|---|
| 4,628,959 | 12/1986 | Parker et al. | 137/526 |
| 4,886,085 | 12/1989 | Miller | 137/526 |
| 5,623,911 | 4/1997 | Kiyomiya et al. | 123/520 |
| 5,727,530 | 3/1998 | Honda et al. | 123/520 |
| 5,730,107 | 3/1998 | Blumenstock | 123/520 |
| 5,749,349 | 5/1998 | Dertweiler et al. | 123/520 |
| 5,803,054 | 9/1998 | Yamazaki | 123/519 |
| 5,850,819 | 12/1998 | Kunimitsu et al. | 123/520 |
| 5,853,018 | 12/1998 | Deland | 123/520 |
| 5,853,162 | 12/1998 | Zurke | 137/526 |

*Primary Examiner*—Thomas N. Moulis

[57] ABSTRACT

A module for an on-board evaporative emission leak detection system that detects leakage from an evaporative emission space of a fuel system of an automotive vehicle. The module has a housing that includes a first port for communicating the housing to the evaporative emission space and a second port for communicating the housing to atmosphere. The housing contains a particulate filter through which the second port communicates with two parallel flow branches that extend within the housing to the first port. One branch contains a vacuum regulator valve, and the other, a solenoid-operated vent valve. During a leak detection test, the vent valve is operated closed, and a purge valve, that selectively communicates the evaporative emission space with the engine intake manifold, is operated open to cause vacuum to be drawn in the evaporative emission space. The vacuum regulator valve regulates evaporative emission space vacuum to a defined vacuum. Subsequently, the purge valve is operated closed. Leakage is evidenced by loss of vacuum, and a pressure sensor signals vacuum loss.

21 Claims, 5 Drawing Sheets

AUTOMOTIVE EVAPORATIVE EMISSION LEAK DETECTION SYSTEM AND MODULE

REFERENCE TO RELATED APPLICATION AND PRIORITY CLAIM

This application expressly claims the benefit of earlier filing date and right of priority from the following patent applications: U.S. Provisional Application Ser. No. 60/058,151 filed on Sep. 8, 1997 in the names of Cook et al, entitled "Vacuum Leak Detection System," and U.S. Provisional Application Ser. No. 60/058,275 filed on Sep. 09, 1997 in the names of Cook et al., entitled "Evaporative Emission Leak Detection System;" each of which provisional patent application is expressly incorporated in its entirety by reference.

FIELD OF THE INVENTION

This invention relates generally to an on-board system for detecting fuel vapor leakage from an evaporative emission space of an automotive vehicle fuel system. More particularly it relates to a system that utilizes vacuum drawn by the engine intake manifold for performing a leak test, and to a module for such a system.

BACKGROUND OF THE INVENTION

A known on-board evaporative emission control system for an automotive vehicle comprises a vapor collection canister that collects volatile fuel vapors generated in the headspace of the fuel tank by the volatilization of liquid fuel in the tank and a purge valve for periodically purging fuel vapors to an intake manifold of the engine. A known type of purge valve, sometimes called a canister purge solenoid (or CPS) valve, comprises a solenoid actuator that is under the control of a microprocessor-based engine management system, sometimes referred to by various names, such as an engine management computer or an engine electronic control unit.

During conditions conducive to purging, evaporative emission space that is cooperatively defined primarily by the tank headspace and the canister is purged to the engine intake manifold through the canister purge valve. A CPS-type valve is opened by a signal from the engine management computer in an amount that allows intake manifold vacuum to draw fuel vapors that are present in the tank headspace and/or stored in the canister for entrainment with combustible mixture passing into the engine's combustion chamber space at a rate consistent with engine operation so as to provide both acceptable vehicle driveability and an acceptable level of exhaust emissions.

Certain governmental regulations require that certain automotive vehicles powered by internal combustion engines which operate on volatile fuels such as gasoline, have evaporative emission control systems equipped with an on-board diagnostic capability for determining if a leak is present in the evaporative emission space. It has heretofore been proposed to make such a determination by temporarily creating a pressure condition in the evaporative emission space which is substantially different from the ambient atmospheric pressure, and then watching for a change in that substantially different pressure which is indicative of a leak.

It is believed fair to say that there are two basic types of diagnostic systems and methods for determining integrity of an evaporative emission space against leakage.

Commonly owned U.S. Pat. No. 5,146,902 "Positive Pressure Canister Purge System Integrity Confirmation" discloses one type: namely, a system and method for making a leakage determination by pressurizing the evaporative emission space to a certain positive pressure therein (the word "positive" meaning relative to ambient atmospheric pressure) and then watching for a drop in positive pressure indicative of a leak. Other positive pressure type systems are disclosed in commonly owned U.S. Pat. Nos. 5,383,437; and 5,474,050.

The other of the two general types of systems for making a leakage determination does so by creating in the evaporative emission space a certain negative pressure (the word "negative" meaning relative to ambient atmospheric pressure so as to denote vacuum) and then watching for a loss of vacuum indicative of a leak. A known procedure employed by this latter type of system in connection with a diagnostic test comprises utilizing engine manifold vacuum to create vacuum in the evaporative emission space. Because that space may, at certain non-test times, be vented through the canister to allow vapors to be efficiently purged when the CPS valve is opened for purging fuel vapors from the tank headspace and canister, it is known to communicate the canister vent port to atmosphere through a vent valve that is open when vapors are being purged to the engine, but that closes preparatory to a diagnostic test so that a desired test vacuum can be drawn in the evaporative emission space for the test. Once a desired vacuum has been drawn, the purge valve is closed, and leakage appears as a loss of vacuum during the length of the test time after the purge valve has been operated closed.

In order for an engine management computer to ascertain when a desired vacuum has been drawn so that it can command the purge valve to close, and for loss of vacuum to thereafter be detected, it is known to employ an electric sensor, or transducer, that measures negative pressure, i.e. vacuum, in the evaporative emission space by supplying a measurement signal to the engine management computer. It is known to mount such a sensor on the vehicle's fuel tank where it will be exposed to the tank headspace. For example, commonly owned U.S. Pat. No. 5,267,470 discloses a pressure sensor mounting in conjunction with a fuel tank roll-over valve.

SUMMARY OF THE INVENTION

One generic aspect of the present invention relates to an automotive vehicle comprising: a fuel-consuming internal combustion engine that powers the vehicle and comprises an intake manifold; a fuel supply system comprising a tank for storing volatile liquid fuel to be consumed by the engine; an evaporative emission control system for controlling escape of volatized fuel vapors from the evaporative emission space of the evaporative emission control system to atmosphere; the evaporative emission control system comprising a fuel vapor collection device that allows the evaporative emission space to be vented to atmosphere while disallowing escape of fuel vapors from the evaporative emission space to atmosphere; a purge valve for selectively opening and closing the evaporative emission space to the intake manifold to allow and disallow purging of the fuel vapors from the evaporative emission space to the engine; a vent valve for selectively opening and closing the vapor collection device to atmosphere to allow and disallow venting of the evaporative emission space to atmosphere; and a vacuum regulator that limits the vacuum that can be drawn in the evaporative emission space to a predetermined maximum.

Another generic aspect of the present invention relates to an on-board evaporative emission leak detection system that detects leakage from an evaporative emission space of a fuel system of a fuel-consuming automotive vehicle engine, the system comprising: an inlet port for communicating the system to atmosphere; a flow path extending from the inlet port to the evaporative emission space, the flow path comprising two branches in parallel; a selectively operable valve for opening and closing one of the branches; and a regulator valve for limiting the pressure in the evaporative emission space to a predetermined maximum departure relative to atmosphere by venting the evaporative emission space to atmosphere through the other of the branches when the pressure in the evaporative emission space attempts to rise above that maximum.

Another generic aspect of the present invention relates to a module for an on-board evaporative emission leak detection system for detecting leakage from an evaporative emission space of a fuel storage system that stores volatile liquid fuel for consumption by an engine of an automotive vehicle, the module comprising: a housing having a first port adapted to be placed in communication with the evaporative emission space and a second port adapted to be communicated to atmosphere; two parallel flow branches between the first and second ports; one branch comprising a selectively operable vent valve for opening and closing the one branch; and the other branch comprising a regulator valve for regulating pressure differential between the first and second ports to a defined differential when the vent valve is closed and the differential attempts to increase beyond the defined differential.

Another generic aspect of the present invention relates to a module for an on-board evaporative emission leak detection system for detecting leakage from an evaporative emission space of a fuel storage system for storing volatile liquid fuel for consumption by an engine of an automotive vehicle, the module comprising: a housing comprising a movable wall dividing a first chamber from a second chamber, an atmospheric port for communicating the first chamber to atmosphere, an emission space port for communicating the second chamber to an evaporative emission space, a valve comprising relatively positionable first and second parts, the first part being movable with the movable wall relative to the second part to open and close a flow path through the movable wall between the first and second chambers, a spring biasing the two parts toward closure of the flow path, and the spring and the two chambers having a relationship that causes the flow path to be closed when pressure differential between the two chamber spaces is less than a predetermined differential, and that causes the flow path to be open when the pressure differential between the two chamber spaces is greater than the predetermined differential.

The foregoing, and other features, along with various advantages and benefits of the invention, will be seen in the ensuing description and claims which are accompanied by drawings. The drawings, which are incorporated herein and constitute part of this specification, disclose a preferred embodiment of the invention according to the best mode contemplated at this time for carrying out the invention.

DESCRIPTION OF THE PREFERRED EMBODIMENT

Figure 1:
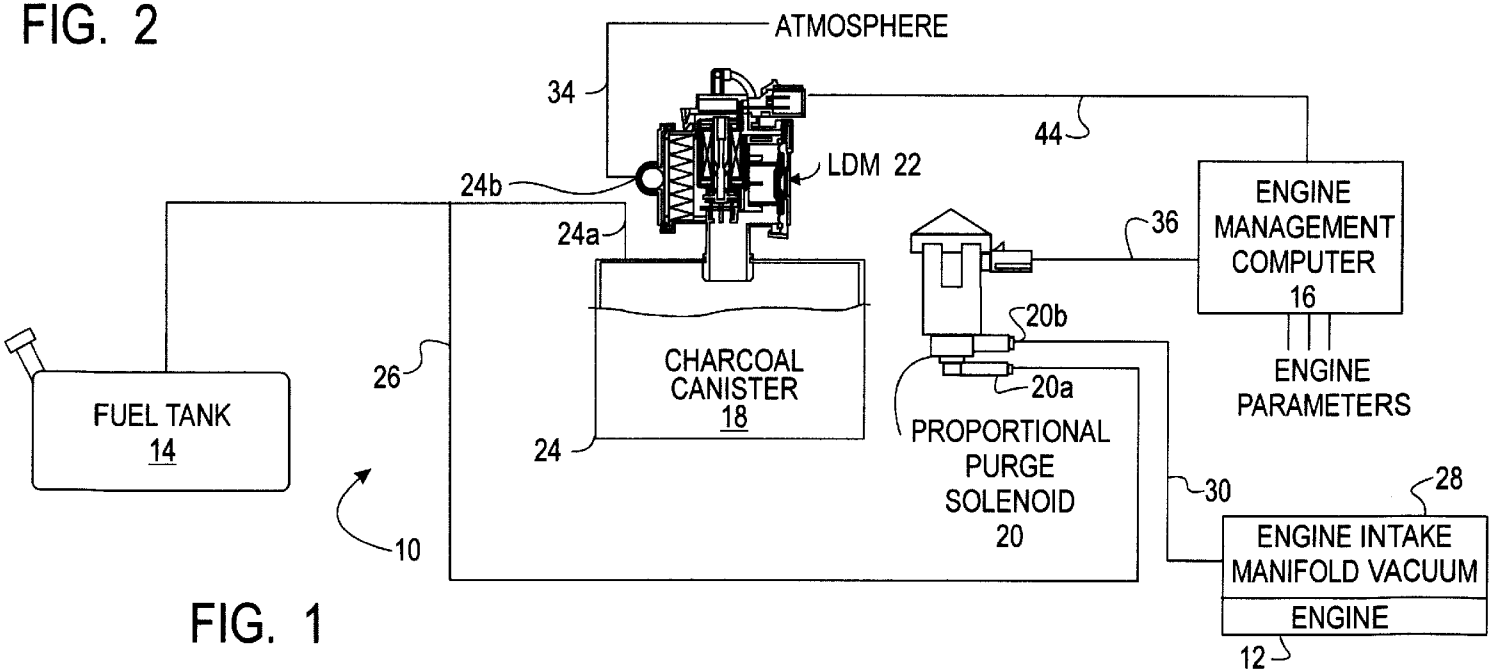
FIG. 1 is a general schematic diagram of an automotive vehicle evaporative emission control system including a leak detection system and leak detection module embodying principles of the invention.

FIG. 1 shows an automotive vehicle evaporative emission control (EEC) system 10 in association with an internal combustion engine 12 that powers the vehicle, a fuel tank 14 that holds a supply of volatile liquid fuel for the engine, and an engine management computer (EMC) 16 that exercises certain controls over operation of engine 12. EEC system 10 comprises a vapor collection canister (charcoal canister) 18, a proportional purge solenoid (PPS) valve 20, and a leak detection module (LDM) 22. In the illustrated embodiment, LDM 22 is shown mounted atop canister 18 so they form an integrated assembly, or module, 24.

Headspace of fuel tank 14, a port 24*a* of module 24, and an inlet port 20*a* of PPS valve 20 are placed in common fluid communication by a conduit 26 so that the tank headspace and the canister cooperatively define evaporative emission space within which fuel vapors generated by volatilization of fuel in tank 14 are temporarily confined and collected until purged to an intake manifold 28 of engine 12. Another conduit 30 fluid-connects an outlet port 20*b* of PPS valve 20 with intake manifold 28. Another conduit 34 fluid-connects a port 24*b* of module 24 to atmosphere.

EMC 16 receives a number of inputs (engine-related parameters for example) relevant to control of certain operations of engine 12 and its associated systems, including EEC system 10. One electrical output port of EMC 16 controls PPS valve 20 via an electrical connection 36; other ports of EMC 16 are coupled with module 24 via electrical connections, depicted generally by the reference numeral 44 in FIG. 1.

From time to time, EMC 16 commands LDM 22 to perform a leak detection test for ascertaining the integrity of EEC system 10, particularly the evaporative emission space that contains volatile fuel vapors, against leakage. During such test times, EMC 16 commands PPS valve 20 to open condition to enable manifold vacuum to be drawn in the evaporative emission space being tested. At times of engine running other than during such test times, EMC 16 operates PPS valve 20 to purge vapors from the evaporative emission space, including vapor adsorbent medium in canister 18, in a scheduled manner, but without creating vacuum magnitudes in the evaporative emission space that are comparable to those drawn during a test. LDM 22 is operated by EMC 16 according to whether testing is being conducted.

EMC 16 selectively operates PPS valve 20 during non-test times such that the valve opens under conditions conducive to purging and closes under conditions not conducive to purging. During those times LDM 22 assumes a condition of providing relatively unrestricted venting of the evaporative emission space to atmosphere. Thus, during times of operation of the automotive vehicle, the canister purge function is performed in a known manner for the particular vehicle and engine so long as a leak detection test is not being performed. When a leak detection test is commenced, EMC 16 operates PPS valve 20 open to communicate the evaporative emission space to intake manifold vacuum, and it causes LDM 22 to close the normally unrestricted vent to atmosphere. Consequently, vacuum begins to be drawn in the evaporative emission space, accompanied by fuel vapor purging. LDM 22 further includes a vacuum regulator valve that is effective during a test to regulate evaporative emission space vacuum to a predetermined magnitude, and once that vacuum has been attained and achieves substantial stability, a leakage determination can be made.

Figure 2:
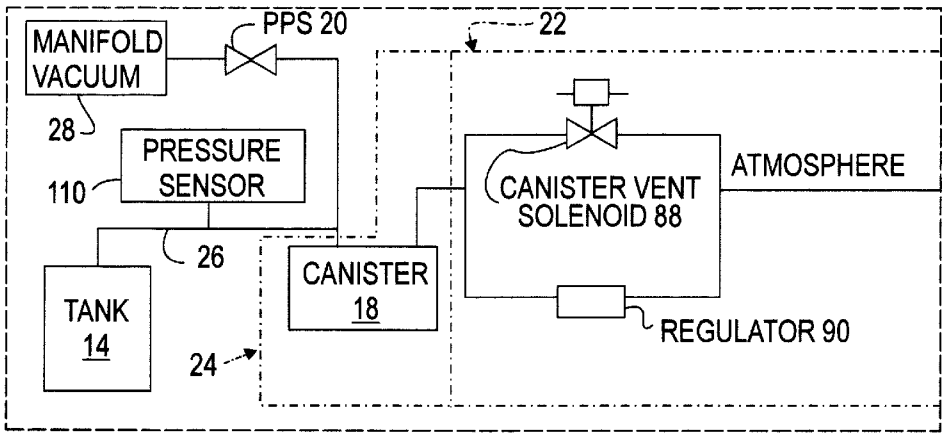
FIG. 2 is a more detailed schematic diagram of certain portions of FIG. 1.

FIG. 2 schematically depicts LDM 22 in conjunction with components already described. Structural detail of LDM 22 is presented in FIGS. 3–6. The latter show LDM 22 to comprise a main body, or housing, 50, preferably fabricated from suitable fuel-resistant plastic. Main body 50, per se, comprises a walled structure having several openings. One opening comprises an integral nipple 52 forming a port through which main body 50 can be placed in fluid communication with the interior of canister 18. Another opening opposite nipple 52 is closed by a sensor cap assembly 54. A third opening in a side wall of main body 50 is closed by a filter cap 56. A fourth opening opposite the third is closed by a regulator cap 58.

Figure 3:
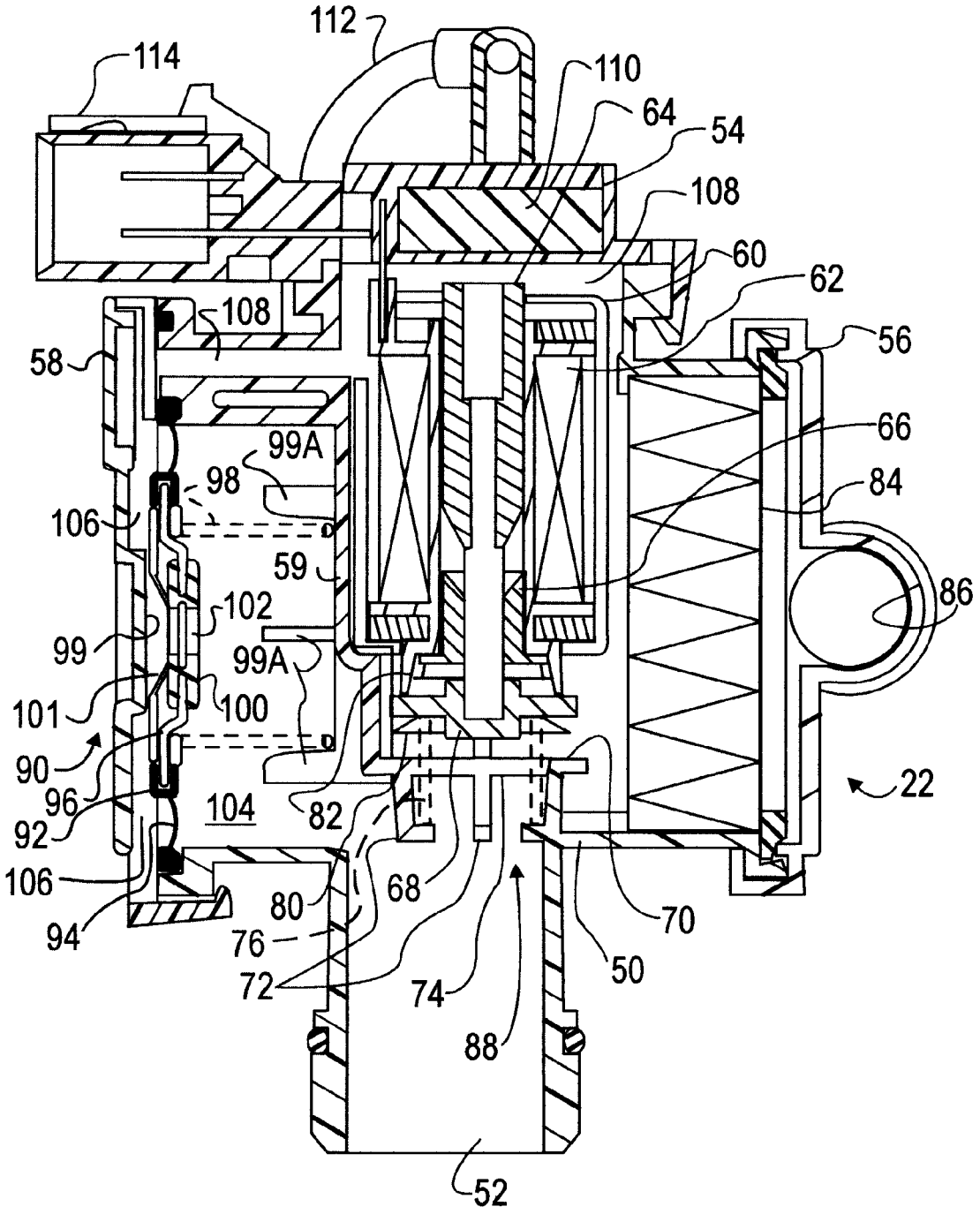
FIG. 3 is an elevation view, in cross section, through an exemplary canister-mounted leak detection module adapted for mounting on a vapor collection canister of an evaporative emission control system.
Figure 6:
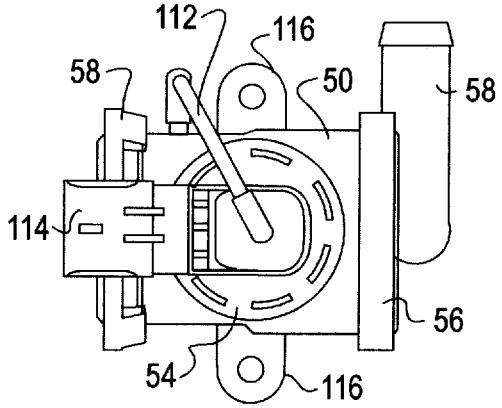
FIG. 6 is a full top view of FIG. 3, on a reduced scale.
Figure 4:
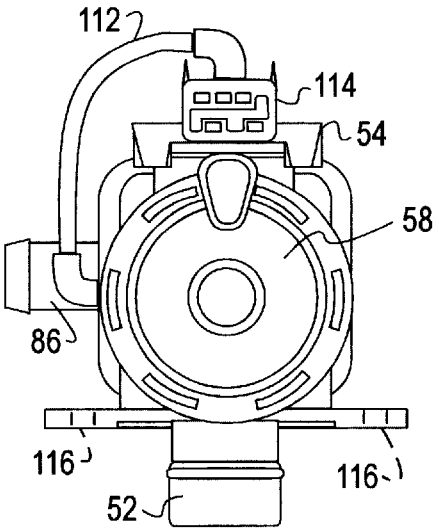
FIG. 4 is a full left side elevation view of FIG. 3, on a reduced scale.
Figure 5:
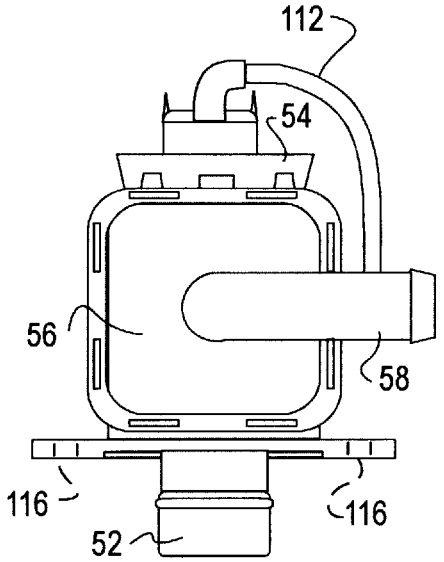
FIG. 5 is a full right side elevation view of FIG. 3, on a reduced scale.

The interior of main body 50 comprises a walled receptacle 59 containing a solenoid assembly 60. Solenoid assembly 60 is assembled into receptacle 59 through the opening that is subsequently closed by sensor cap assembly 54. Solenoid assembly 60 comprises a bobbin-mounted electromagnetic coil 62 and an associated stator structure composed of several ferromagnetic parts to form a portion of the solenoid's magnetic circuit. A cylindrical ferromagnetic armature 64 cooperates with this stator structure to complete the magnetic circuit via air gaps between the stator structure and the armature. Armature 64 is arranged coaxial with a main axis of the solenoid and is guided for straight line motion along that axis within the bobbin that contains coil 62. As shown by FIG. 3, the confronting, complementary tapered, axial ends of armature 64 and a stator part 66 are separated by an air gap of the magnetic circuit.

A non-ferromagnetic valve element 68 has a circular-shaped head and a cylindrical stem for attachment to armature 64. Receptacle 59 comprises an integral valve seat 70, including several formations 72 disposed around a central through-hole 74 therein which provide a seat for seating one end of a helical coiled compression spring 76. The other end of spring 76 is centered on the face of the head of valve element 68, fitting over a boss formed in the valve head face. The valve head contains an annular one-piece lip seal 80. Spring 76 continuously biases the valve head away from seat 70 and toward a stop 82 so that the through-hole 74 is normally open. Thus, solenoid assembly 60 and valve seat 70 form a normally open solenoid-operated valve within main body 50.

The opening in main body 50 that is closed by filter cap 56 encloses a particulate filter element 84 within the main body. Filter element 84 is in filtering relation to a nipple 86 forming a port that extends from filter cap 56 as an integral formation thereof. Interior of main body 50, filter element 84 faces a side of receptacle 59. The receptacle wall contains an opening that places the filter element in fluid communication with valve seat 70 on the interior end of through-hole 74. Hence, when seal 80 is not seated on seat 70, the valve is open, allowing substantially unrestricted flow through filter element 84 between nipples 86 and 52. When seal 80 seats on the seat closing the valve, that flow path is closed. The solenoid-operated valve may therefore be identified as a canister vent solenoid valve (CVS valve), shown schematically at 88 in FIG. 2 as one portion of LDM 22.

FIG. 2 shows LDM 22 to also comprise a vacuum regulator valve 90 in parallel flow relation with CVS valve 88. Vacuum regulator valve 90 comprises a movable wall 92 disposed in covering relation to the opening in main body 50 that is closed by regulator cap 58. Movable wall 92 comprises a generally annular part 94 containing a flexible convolution. The otherwise open center of part 94 is closed by a rigid circular, annular insert 96. The outer margin of insert 96 is offset relative to its center to provide a seat for one axial end of a helical coil compression spring 98. The opposite axial end of spring 98 seats within a circular array of formations 99A on a side of receptacle 59 opposite filter element 84. Spring 98 therefore continuously urges the central region of movable wall 92 axially in a direction toward regulator cap 58.

At its center, regulator cap 58 contains a flat surface 99 confronting the center of insert 96. The center of the insert contains a part 100, preferably elastomeric in character, having a main body that fills the circular hole that would otherwise be open in the center of insert 96. Part 100 includes an integral frustoconical lip 101 that in the position depicted by FIG. 3 is shown sealing against surface 99 due to the bias force exerted by spring 98. At its center, insert 96 has a through-hole 102. In the FIG. 3 position, the sealed relationship of lip 101 with surface 99 effectively prevents flow through the through-hole. Displacement of insert 96 away from the FIG. 3 position will unseal lip 101 from surface 99 to allow flow through through-hole 102.

The placement of movable wall 92 across the opening that is closed by regulator cap 58 serves to divide a first chamber 104 from a second chamber 106. FIG. 3 shows chamber 104 to be continuously open to nipple 52. Also, chamber 106 is continuously open to nipple 86 through filter element 84 via an internal passage 108 that includes a hole through the margin of part 94 aligned with an end of a hole in main body 50.

Disposed within the body opening that is closed by sensor cap assembly 54 is a pressure sensor 110. This body opening provides a receptacle for the body of sensor 110 including an opening that communicates an atmospheric reference port of the sensor to passage 108. The sensor comprises a vacuum sensing port that is continuously communicated by a hose assembly 112 to chamber 104. Sensor 110 provides to EMC 16 a signal representing the pressure difference between its two sensing ports, hence a signal representing the magnitude of vacuum in chamber 104 referenced to essentially atmosphere. Alternatively, the sensor may be a switch that switches at a certain pressure differential. Electric circuit connections from EMC 16 to sensor 110 and to solenoid assembly 60 are provided by a connector 114 disposed on the exterior of main body 50 and containing several electric terminals.

In module 24, nipple 52 passes through a top wall of the casing of canister 18 to communicate LDM 22 to the "clean air" side of vapor adsorbent medium within the canister casing. As shown by FIGS. 1 and 2, the "dirty air" side of the vapor adsorbent medium within canister 18 is in continuous communication with the evaporative emission space. Main body 50 comprises apertured tabs 116 that allow it to be fastened to the canister casing by fasteners (not shown).

Now that the construction of an exemplary embodiment of module 24 has been described in detail, it is appropriate to give a general explanation its operation. When no leak test is being performed, PPS valve 20 is operated by EMC 16 to periodically purge vapors from canister 18 and the tank headspace to engine 12. The exact scheduling of such purging is controlled by the vehicle manufacturer's requirements. During non-test times, a nonrestrictive vent path to atmosphere is open through module 24 so that the evaporative emission space is communicated to atmosphere, keeping the evaporative emission space generally at atmospheric pressure.

At the commencement of a leak test on EEC system 10, solenoid assembly 60 is operated closed, closing the atmospheric vent path through valve 88 of LDM 22. PPS valve 20 is operated open causing vacuum to be drawn in the evaporative emission space under test, including headspace of tank 14, canister 18, and any spaces, such as associated conduits, that are in communication therewith. Naturally all closures, such as the vehicle tank filler cap, must be in place to close the evaporative emission space under test except for the vacuum being drawn through PPS valve 20.

If no extraordinary conditions, such as a "pinched line" or a "gross leak" for example, are present, vacuum regulator valve 90 will become effective to regulate the vacuum in the evaporative emission space to the regulator valve's setting, and sensor 110 will detect when regulated vacuum has been attained. Once regulation commences, an appropriate amount of time is allowed for stability to be attained before the actual leak determination, or measurement, is undertaken.

Vacuum regulation occurs in the following manner. When the drawn vacuum reaches the setting of the vacuum regulator valve, movable wall overcomes the force of spring 98 to unseat lip 101 from surface 99 in a fashion that maintains the evaporative emission space vacuum at the regulator valve's setting. At the regulated vacuum setting, air passes through nipple 86, filter element 84, passage 108, chamber 106, and through-hole 102 into chamber 104, and thence into the evaporative emission space under test, at a rate which maintains the vacuum at the regulator setting. It should be noted that vacuum regulator valve 90 is associated with the system in a manner that provides a flow path to atmosphere which is wholly independent of the fuel vapor purge flow path to the engine through valve 20. Hence, it may be incorporated into a system without inducing any significant effect on fuel vapor purging. This is a distinct advantage because it allows fuel vapor purging to continue according to programmed schedule during a leak detection test. A typical vacuum setting for regulator valve 90 is 8.0 inches $H_2O$, a vacuum considerably smaller than customary intake manifold vacuum.

The actual leak determination, or measurement, begins by re-closing PPS valve 20 while valve 88 of LDM 22 remains closed. Regulator valve 90 will then cease to regulate because vacuum can now only decrease in magnitude. Leakage is determined by utilizing sensor 110 to indicate loss of vacuum as test time elapses.

Figure 7A:
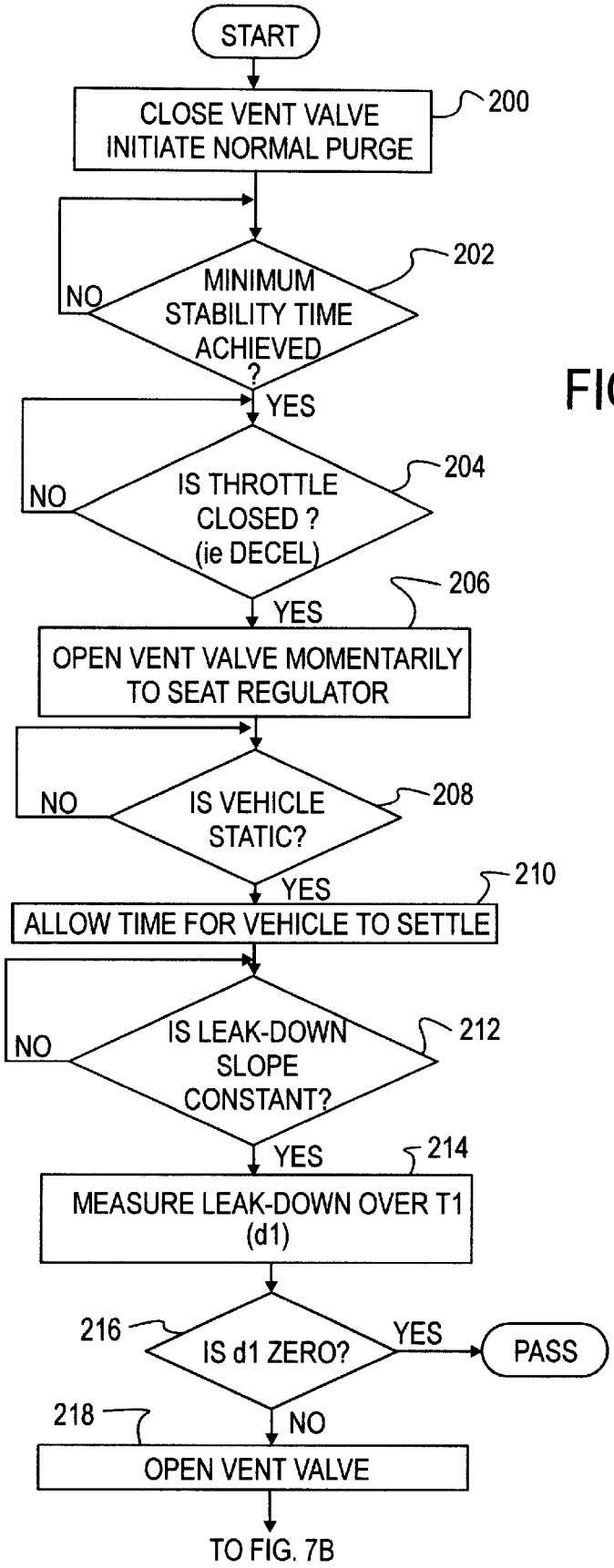
FIGS. 7A and 7B collectively form a flow diagram illustrating steps in the performance of a leak test.
Figure 7B:
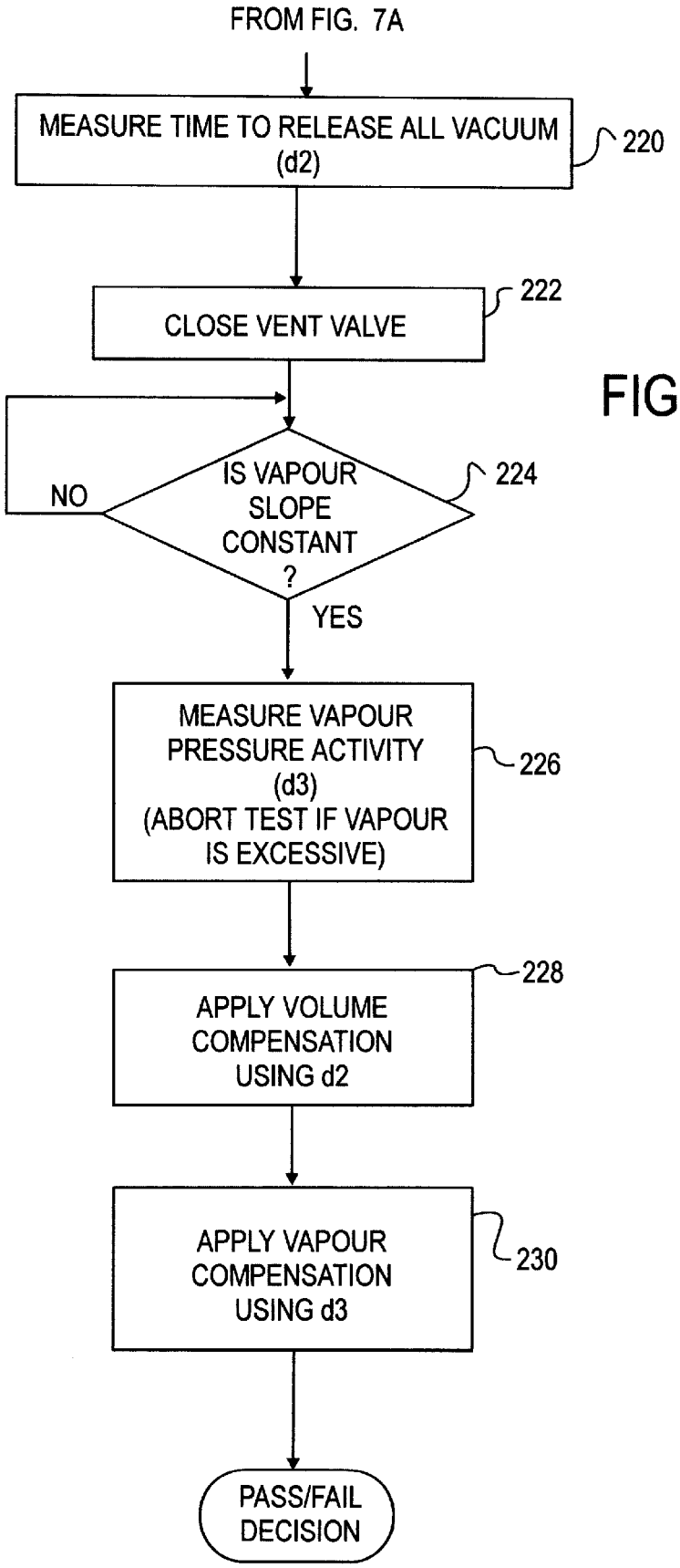

FIGS. 7A and 7B collectively illustrate steps of a leak detection test that is conducted in accordance with the foregoing general description. Step 200 comprises operating valve 88 to close the path to atmosphere through it, and also opening PPS valve 20 to intake manifold 28. Intake manifold vacuum of the running engine is therefore delivered through valve 20 to the evaporative emission space being tested, and accordingly, vacuum begins to be drawn in the evaporative emission space.

Step 202 comprises allowing a certain amount of time to elapse so that regulator valve 90 can become effective to perform its intended negative pressure (i.e. vacuum) regulating function. Step 204 checks throttle position to allow the test to proceed only so long as the engine throttle remains closed while the vehicle is stopped.

After the stability time allotted by step 202 has elapsed, and while the throttle continues to be closed, step 206 is performed to cause valve 88 to momentarily open. That action will be effective to reduce the vacuum sufficiently to assure that lip 101 is sealed against surface 99, preventing flow through through-hole 102. Before the leak test is allowed to proceed, step 208 checks to confirm that the vehicle is remaining static, and step 210 allows a certain amount of settling time to allow potential disturbances, such as liquid fuel slosh in the tank, to subside.

After steps 208 and 210 have concluded, the presence of a leak will be reflected as a signal that decreases at a substantially constant rate. Pressure sensor 110 provides a signal representative of vacuum, and step 212 confirms that a graph plot of vacuum vs. time would show the vacuum to be decreasing with a substantially constant slope, which will be the case for leaks less than a gross leak provided that a stable environment continues to exist for the test. Absence of a leak would yield a graph plot that has zero slope; decreasing vacuum at other than a substantially constant slope would be indicative of system instability.

Once the assurance of step 212 has been obtained, step 214 measures the decrease in vacuum that occurs over a defined time T1. That measurement is designated d1. Step 216 distinguishes the absence of leakage from leakage less than a gross leak. If there is no leakage, vacuum will remain unchanged so that the corresponding graph plot slope is zero. In such a case, the test is deemed to have been passed, and an appropriate indication is given. That concludes the test.

On the other hand, a leak less than a gross leak will be measured for effective leak area size. The measurement is obtained by first performing step 218 which comprises opening valve 88. Upon the opening of valve 88, step 220 commences measuring the time required for vacuum to be reduced to zero. That measurement is designated d2, and it is indicative of the volume of the evaporative emission space, i.e. the volume of the fuel system that is occupied by vaporized, as distinguished from liquid, fuel. Upon the vacuum being reduced to zero, step 222 re-closes valve 88 preparatory to obtaining a measurement of the rate of fuel volatilization in the tank.

Step 224 monitors the pressure in the evaporative emission space for the attainment of a substantially constant rate of increase of pressure therein, which is deemed indicative of the rate at which liquid fuel is being volatized. Provided that the rate is not excessive, as determined by step 226, the rate of pressure increase is logged as a parameter designated d3.

Steps 228 and 230 compute and apply respective correction factors to the d1 measurement. The corrected measurement is compared against a predefined area to determine whether the measured area is acceptable or unacceptable, and a corresponding indication of either a pass decision or a fail decision is given.

While a presently preferred embodiment of the invention has been illustrated and described, it should be appreciated that principles are applicable to other embodiments that fall within the scope of the following claims.

What is claimed is:

1. An automotive vehicle comprising:

a fuel-consuming internal combustion engine that powers the vehicle and comprises an intake manifold;

a fuel storage system for storing volatile liquid fuel for consumption by the engine and comprising an evaporative emission space for containing fuel vapor;

an evaporative emission control system comprising a vent valve for selectively opening and closing a vent path from the evaporative emission space to atmosphere, a fuel vapor collection medium disposed in the vent path for trapping fuel vapors so their escape to atmosphere through the vent path is prevented, and a purge valve for selectively opening and closing a vapor purge path from the evaporative emission space to the intake manifold to selectively purge fuel vapors from the evaporative emission space and medium to the engine; and a vacuum regulator valve for regulating vacuum in the evaporative emission space to a defined magnitude when the vent valve is closed, the purge valve is open, and the engine is running.

2. An automotive vehicle as set forth in claim 1 in which the vent valve and the vacuum regulator valve are disposed in parallel flow relation between the medium and atmosphere.

3. An automotive vehicle as set forth in claim 2 in which the vent valve and the vacuum regulator valve are contained within a housing having a first port that is communicated to the medium and a second port that is communicated to atmosphere.

4. An automotive vehicle as set forth in claim 3 in which a particulate filter is disposed within the housing in filtering relation to flow through the vent path and through the vacuum regulator valve.

5. An automotive vehicle as set forth in claim 3 in which the medium is contained within a further housing, and the two housings are assembled together to form a module.

6. An automotive vehicle as set forth in claim 3 in which the housing also contains a vacuum sensor disposed to sense vacuum at the first port.

7. An on-board evaporative emission leak detection system for detecting leakage from an evaporative emission space of a fuel storage system for storing volatile liquid fuel for consumption by an engine of an automotive vehicle, the leak detection system comprising:

two parallel flow branches between the evaporative emission space and atmosphere;

one branch comprising a selectively operable vent valve for opening and closing the one branch; and the other branch comprising a regulator valve for regulating pressure differential between atmosphere and the evaporative emission space to a defined differential when the vent valve is closed and the differential attempts to increase beyond the defined differential.

8. A leak detection system as set forth in claim 7 in which the regulator valve comprises a vacuum regulator for regulating vacuum in the evaporative emission space to a defined vacuum in the evaporative emission space when the vent valve is closed and vacuum in the evaporative emission space attempts to increase beyond the defined vacuum level.

9. A leak detection system as set forth in claim 8 in which the vacuum regulator is set to regulate to a nominal vacuum of approximately 8.0 inches $H_2O$.

10. A leak detection system as set forth in claim 7 in which the vent valve and the regulator valve are contained within a housing having a first port that is communicated to the evaporative emission space and a second port that is communicated to atmosphere.

11. A leak detection system as set forth in claim 10 in which a particulate filter is disposed within the housing in filtering relation to flow through both the vent valve and the regulator valve.

12. A leak detection system as set forth in claim 10 including a further housing containing a vapor adsorbent medium, and in which the two housings are assembled together to form a module wherein the first port is communicated to the evaporative emission space through the vapor adsorbent medium.

13. A leak detection system as set forth in claim 10 in which the housing also contains a sensor disposed to sense pressure at the first port.

14. A leak detection system as set forth in claim 13 in which the sensor comprises a vacuum sensor disposed to sense vacuum at the first port.

15. A module for an on-board evaporative emission leak detection system for detecting leakage from an evaporative emission space of a fuel storage system that stores volatile liquid fuel for consumption by an engine of an automotive vehicle, the module comprising:

a housing having a first port adapted to be placed in communication with the evaporative emission space and a second port adapted to be communicated to atmosphere;

two parallel flow branches between the first and second ports;

one branch comprising a selectively operable vent valve for opening and closing the one branch; and the other branch comprising a regulator valve for regulating pressure differential between the first and second ports to a defined differential when the vent valve is closed and the differential attempts to increase beyond the defined differential.

16. A module as set forth in claim 15 in which the regulator valve comprises a vacuum regulator for regulating vacuum at the first port to a defined vacuum when the vent valve is closed and vacuum at the first port attempts to increase beyond the defined vacuum.

17. A module as set forth in claim 15 in which a particulate filter is disposed within the housing in filtering relation to flow through both the vent valve and the regulator valve.

18. A module as set forth in claim 15 in which the housing also contains a sensor disposed to sense pressure at the first port.

19. A module as set forth in claim 18 in which the sensor comprises a vacuum sensor disposed to sense vacuum at the first port.

20. A module as set forth in claim 15 including a further housing containing a vapor adsorbent medium, and the two housings are assembled together to communicate the first port to the medium so that when the first port is communicated to the evaporative emission space, such communication is through the medium.

21. A module for an on-board evaporative emission leak detection system for detecting leakage from an evaporative emission space of a fuel storage system for storing volatile liquid fuel for consumption by an engine of an automotive vehicle, the module comprising:

a housing comprising a movable wall dividing a first chamber from a second chamber, an atmospheric port for communicating the first chamber to atmosphere, an emission space port for communicating the second chamber to an evaporative emission space, a valve comprising relatively positionable first and second parts, the first part being movable with the movable wall relative to the second part to open and close a flow path through the movable wall between the first and second chambers, a spring biasing the two parts toward closure of the flow path, and the spring and the two chambers having a relationship that causes the flow path to be closed when pressure differential between the two chamber spaces is less than a predetermined differential, and that causes the flow path to be open when the pressure differential between the two chamber spaces is greater than the predetermined differential.

* * * * *

UNITED STATES PATENT AND TRADEMARK OFFICE

Certificate

Patent No. 6,053,151 Patented: April 25, 2000

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: John E. Cook, Paul D. Perry, Paul V. Terek, and Craig A. Weldon, all of Chatham, Canada.

Signed and Sealed this Second Day of January, 2001.

HENRY C. YUEN
Art Unit 3747